US009501017B2

(12) United States Patent
Shirafuji

(10) Patent No.: US 9,501,017 B2
(45) Date of Patent: Nov. 22, 2016

(54) IMAGE FORMING APPARATUS THAT SUPPRESSES FLUCTUATIONS IN DENSITY OF SUCCESSIVELY FORMED IMAGES EVEN IF CHARGE AMOUNT OF DEVELOPER CHANGES

(71) Applicant: CANON KABUSHIKI KAISHA, Tokyo (JP)

(72) Inventor: Yasuhito Shirafuji, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/855,666

(22) Filed: Sep. 16, 2015

(65) Prior Publication Data

US 2016/0085194 A1 Mar. 24, 2016

(30) Foreign Application Priority Data

Sep. 18, 2014 (JP) ..... 2014-190115
Jul. 17, 2015 (JP) ..... 2015-143110

(51) Int. Cl.
*G03G 15/00* (2006.01)

(52) U.S. Cl.
CPC ..... *G03G 15/5025* (2013.01); *G03G 15/5041* (2013.01); *G03G 2215/00029* (2013.01)

(58) Field of Classification Search
CPC ..... G03G 15/5041; G03G 15/5025; G03G 15/5033; G03G 15/5058; G03G 2215/00029
USPC ..... 399/49
See application file for complete search history.

(56) References Cited

U.S. PATENT DOCUMENTS 5,491,536 A * 2/1996 Mashiba ..... G03G 15/0266 399/55
5,583,644 A 12/1996 Sasanuma
6,418,281 B1 * 7/2002 Ohki ..... G03G 15/5062 358/300

* cited by examiner

*Primary Examiner* — David Gray
*Assistant Examiner* — Trevor J Bervik
(74) *Attorney, Agent, or Firm* — Canon U.S.A., Inc. IP Division

(57) ABSTRACT

An image forming apparatus includes a conversion unit configured to convert image data based on a conversion condition, an image forming unit configured to be controlled based on an image forming condition, and to form an image based on the converted image data, a measurement unit configured to measure a plurality of measurement images, a first determination unit configured to determine the image forming condition based on a first measurement result of a first measurement image, a generation unit configured to generate the conversion condition based on second measurement results of second measurement images and a feedback condition, and a second determination unit configured to determine the feedback condition based on the first measurement result. The image forming unit sets the determined image forming condition in next timing. The conversion unit updates the conversion condition after the generation unit generates the conversion condition and before the next timing.

15 Claims, 13 Drawing Sheets

TEST PATTERN R
(10 GRADATIONS)

IMAGE FORMING APPARATUS THAT SUPPRESSES FLUCTUATIONS IN DENSITY OF SUCCESSIVELY FORMED IMAGES EVEN IF CHARGE AMOUNT OF DEVELOPER CHANGES

BACKGROUND OF THE INVENTION

Field of the Invention

The present invention relates to density control of an image formed by an image forming apparatus.

Description of the Related Art

An electrophotographic image forming apparatus forms an image by converting image data based on a conversion condition, and forming an electrostatic latent image on a photosensitive member based on the converted image data, and then developing the electrostatic latent image using a developer in a developing device. Density of an image formed by the image forming apparatus varies according to a charge amount of the developer in the developing device. When the charge amount of the developer decreases, the density of the image formed by the image forming apparatus increases. In contrast, when the charge amount of the developer increases, the density of the image formed by the image forming apparatus decreases.

For the electrophotographic image forming apparatus, it is important to control the charge amount of the developer in the developing device to a target value so as to form an image of desired density. However, the charge amount of the developer in the developing device varies according to a temperature, a humidity, a time period for which the developer is agitated, and the like. In this connection, an image forming apparatus discussed in U.S. Pat. No. 6,418,281 updates a conversion condition based on a measurement result of a measurement image measured by a measurement unit, so as to form an image of desired density even if a change occurs in a charge amount of a developer. Density characteristics of the image formed by the image forming apparatus are corrected by updating the conversion condition.

For example, in a case where the conversion condition is updated each time the image forming apparatus forms images of a predetermined number of pages, the density characteristics of images can be corrected to desired density characteristics even while the image forming apparatus successively forms images.

However, if the conversion condition is updated after an image of an Nth page is formed and before an image of an (N+1)th page is formed while the image forming apparatus successively forms images, a difference between density of the image of the Nth page and density of the image of the (N+1)th page may increase. This occurs when the charge amount of the developer in the developing device greatly changes while the image forming apparatus successively forms images, and accordingly the density characteristics obtained after the conversion condition is updated greatly differs from the density characteristics obtained before the conversion condition is updated.

SUMMARY OF THE INVENTION

According to an aspect of the present invention, an image forming apparatus includes a conversion unit configured to convert image data based on a conversion condition, an image forming unit configured to be controlled based on an image forming condition, and to form an image based on the converted image data, a transfer unit configured to transfer the image onto a sheet, a measurement unit configured to measure a plurality of measurement images formed by the image forming unit, the plurality of measurement images including a first measurement image and second measurement images, a first determination unit configured to determine the image forming condition based on a first measurement result of the first measurement image measured by the measurement unit, a generation unit configured to generate the conversion condition based on second measurement results of the second measurement images measured by the measurement unit and a feedback condition, and a second determination unit configured to determine the feedback condition based on the first measurement result. The image forming unit sets the determined image forming condition in next timing, as the image forming condition. The conversion unit updates the conversion condition after the generation unit generates the conversion condition and before the next timing.

Further features of the present invention will become apparent from the following description of exemplary embodiments with reference to the attached drawings.

DESCRIPTION OF THE EMBODIMENTS

Figure 1:
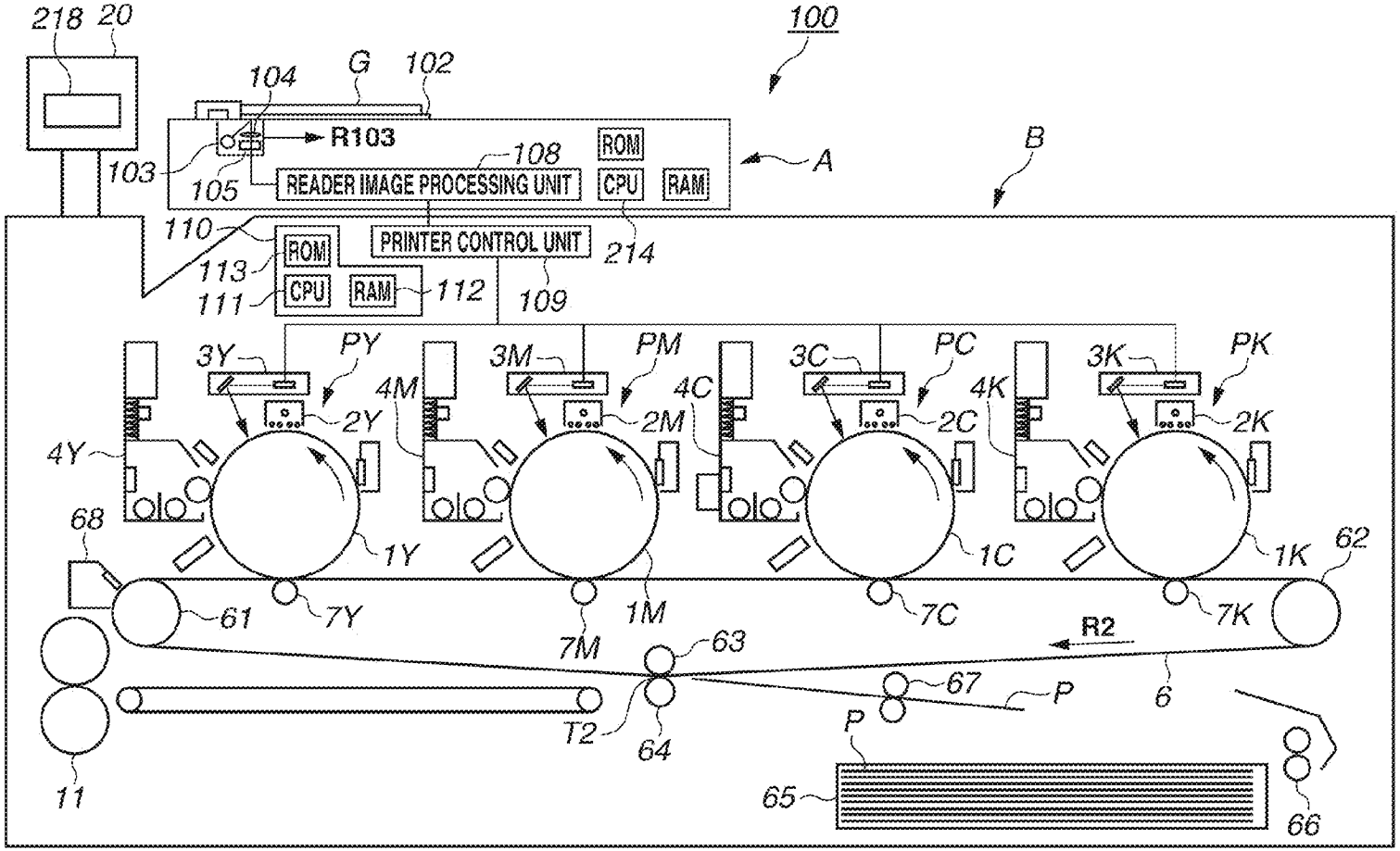
FIG. 1 is a schematic cross-sectional view of an image forming apparatus.

FIG. 1 is a schematic cross-sectional view of an image forming apparatus 100. The image forming apparatus 100 is a full color printer in which image forming units PY, PM, PC, and PK of yellow, magenta, cyan, and black, respectively, are disposed.

In the image forming unit PY, a toner image of a yellow component is formed on a photosensitive drum 1Y, and then transferred onto an intermediate transfer belt 6. In the image forming unit PM, a toner image of a magenta component is formed on a photosensitive drum 1M, and then transferred to be superimposed on the toner image of the yellow component on the intermediate transfer belt 6. In the image forming units PC and PK, a toner image of a cyan component and a toner image of a black component are formed on photosensitive drums 1C and 1K, respectively, and then sequentially transferred to be superimposed on the intermediate transfer belt 6 in a similar manner. A full-color toner image is thereby borne on the intermediate transfer belt 6.

The full-color toner image borne on the intermediate transfer belt 6 is conveyed to a secondary transfer portion T2, to be transferred from the intermediate transfer belt 6 onto a recording material P. When the recording material P onto which the full-color toner image is transferred is conveyed to a fixing device 11, the fixing device 11 melts the toner image borne on the recording material P and fixes the toner image onto the recording material P, by heat and pressure of a fixing member. The recording material P onto which the toner image is fixed is discharged from the image forming apparatus 100.

The intermediate transfer belt 6 is stretched over a tension roller 61, a drive roller 62, and a counter roller 63 to be supported by these rollers. The intermediate transfer belt 6 is driven by the drive roller 62 to rotate in an arrow R2 direction at a predetermined speed.

Upon being fed from a recording material cassette 65, recording materials P are separated one by one by a separating roller 66, and then fed to a registration roller 67. The registration roller 67 controls a conveyance speed and conveyance timing of the recording material P so that timing when the recording material P reaches the secondary transfer portion T2 matches timing when the toner image borne on the intermediate transfer belt 6 reaches the secondary transfer portion T2.

A secondary transfer roller 64 contacts the intermediate transfer belt 6 supported by the counter roller 63, to form the secondary transfer portion T2. By application of a transfer voltage (a direct-current voltage of positive polarity) to the secondary transfer roller 64, the toner image borne on the intermediate transfer belt 6 with being negatively charged is secondarily transferred onto the recording material P.

The image forming units PY, PM, PC, and PK have substantially identical configurations, except that toners of different colors of yellow, magenta, cyan, and black are stored in developing units 4Y, 4M, 4C, and 4K, respectively. In the following description, suffixes Y, M, C, and K may be omitted when no distinctions are to be made in particular. The developing units 4Y, 4M, 4C, and 4K each store a developer containing the toner and a carrier.

In the image forming unit P, a charging unit 2, an exposure unit 3, the developing unit 4, a primary transfer roller 7, and a cleaning device 8 (FIG. 2) are disposed around the photosensitive drum 1.

The photosensitive drum 1 includes a photosensitive layer (a photosensitive member) having negative charging polarity that is formed on an outer peripheral surface of an aluminum cylinder. The photosensitive drum 1 is driven to rotate at a predetermined speed in an arrow R1 direction. The photosensitive drum 1 is an organic photoconductor (OPC) photosensitive member having about 40% of a reflectance of near infrared light (960 nm). However, an amorphous silicon-based photosensitive member having a similar reflectance may be used.

The charging unit 2 uses a scorotron charger, and uniformly charges a surface of the photosensitive drum 1 at an electric potential of negative polarity. A charging voltage is applied from a power source unit (not illustrated) to a wire of the charging unit 2, and a grid bias is applied from a power source unit (not illustrated) to a grid part of the charging unit 2.

The exposure unit 3 irradiates the photosensitive drum 1 with a light beam to form an electrostatic latent image on the charged surface of the photosensitive drum 1. The developing unit 4 adheres toner to the electrostatic latent image on the photosensitive drum 1 to develop a toner image.

The primary transfer roller 7 presses the intermediate transfer belt 6 to form a primary transfer portion T1 between the photosensitive drum 1 and the intermediate transfer belt 6. When a transfer voltage is applied to the primary transfer roller 7, the toner image of negative polarity borne on the photosensitive drum 1 is transferred onto the intermediate transfer belt 6 at the primary transfer portion T1.

The cleaning device 8 has a cleaning blade that rubs against the photosensitive drum 1, and cleans the toner that remains on the photosensitive drum 1 without being transferred from the photosensitive drum 1 onto the intermediate transfer belt 6.

A cleaning device 68 has a cleaning blade that rubs against the intermediate transfer belt 6, and cleans the toner that remains on the intermediate transfer belt 6 without being transferred from the intermediate transfer belt 6 onto the recording material P.

The image forming apparatus 100 includes an operation unit 20. The operation unit 20 has a liquid crystal display 218. The operation unit 20 is connected to a central processing unit (CPU) 214 of a reader unit A, and to a control unit 110 of the image forming apparatus 100. Through the operation unit 20, a user can input print conditions such as the number of print sheets for images, and designation of one-sided printing or two-sided printing. A printer unit B performs an image forming process based on print information input from the operation unit 20.

Figure 2:
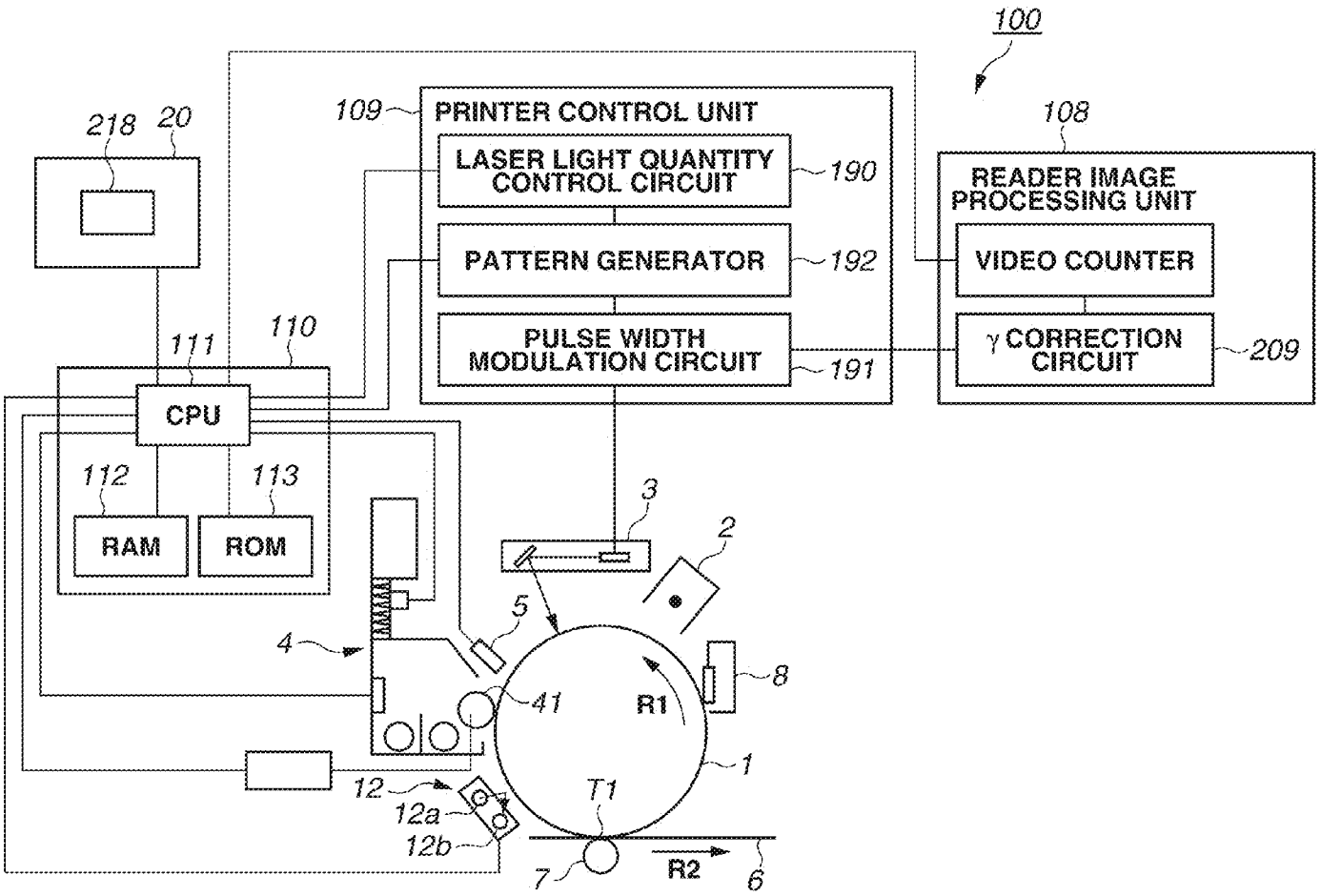
FIG. 2 is a control block diagram of the image forming apparatus.

FIG. 2 is a control block diagram of the image forming apparatus 100. As illustrated in FIG. 2, the image forming apparatus 100 includes the control unit 110 that comprehensively controls the image forming process. The control unit 110 includes a CPU 111, a random access memory (RAM) 112, and a read-only memory (ROM) 113. An electric potential sensor 5 detects an electric potential of an electrostatic latent image formed on the photosensitive drum 1 by the exposure unit 3.

A laser light quantity control circuit 190 controls laser power (exposure intensity) of a light beam emitted from the exposure unit 3. A γ correction circuit 209 converts an input image signal (an input value) included in image data input from the reader unit A, or an input image signal (an input value) included in image data transferred via an interface, into an output image signal (an output value) by referring to a gradation correction table (look-up table (LUT)). Here, the gradation correction table functions as a conversion condition for converting image data. A correspondence between an output image signal and a density level is prestored in the ROM 113.

A pulse width modulation circuit 191 outputs a laser drive signal based on the output image signal output from the γ correction circuit 209. According to the laser drive signal, a semiconductor laser of the exposure unit 3 controls an exposure time (blinking timing) of a light beam. The image forming apparatus 100 forms an image using an area coverage modulation method. Therefore, density of an image formed by the image forming unit P is controlled by the exposure unit 3 controlling the exposure time of the light beam. For this reason, the semiconductor laser has a longer exposure time for a high-density pixel than an exposure time for a low-density pixel.

(Reader Unit A)

Next, the reader unit A (FIG. 1) will be described. Light emitted from a light source 103 is reflected by a document G placed on a platen 102. The light reflected from the document G forms an image on a charge coupled device (CCD) sensor 105 via an optical system 104 such as a lens. A unit including the light source 103, the optical system 104, and the CCD sensor 105 moves in an arrow R103 direction, thereby reading the document G.

When the light reflected from the document G forms the image on the CCD sensor 105, luminance data indicating a read result of the document G is obtained. A reader image processing unit 108 converts the luminance data into density data (image data) using a luminance density conversion table (LUTid_r). The luminance density conversion table (LUTid_r) is prestored in the ROM 113. The reader image processing unit 108 transfers the density data (the image data) to a printer control unit 109. The printer control unit 109 performs image processing on the density data (the image data) transferred from the reader image processing unit 108.

In density control R (FIG. 4) to be described below, when a test chart is placed on the platen 102, and then a read button of the operation unit 20 is pressed by the user, the CPU 214 acquires a read result (luminance data) of the test chart. The read result (the luminance data) of the test chart is converted into density data (read data of a measurement image) using the luminance density conversion table (LUTid_r), and the density data is transmitted to the control unit 110.

(Photosensor)

The image forming unit P has a photosensor 12 located downstream of the developing unit 4 in the rotation direction of the photosensitive drum 1. The photosensor 12 has a light emitting unit 12*a* including a light emitting element such as a light emitting diode (LED), and a light receiving unit 12*b* including a light receiving element such as a photodiode. In the density control R and density control A, a measurement image is formed on the photosensitive drum 1. The light emitting unit 12*a* emits a laser beam toward the photosensitive drum 1, and the light receiving unit 12*b* receives light reflected from the photosensitive drum 1 and from the measurement image formed on the photosensitive drum 1. The photosensor 12 is configured in such a manner that the light receiving unit 12*b* receives only specular reflection light.

The light receiving unit 12*b* outputs a voltage value (0 to 5 V) to the control unit 110 according to intensity of the reflected light received by the light receiving unit 12*b*. An output voltage of the light receiving unit 12*b* decreases as the density of the measurement image formed on the photosensitive drum 1 increases. The output voltage is 5 V when the light receiving unit 12*b* receives light reflected from an area with no toner adhesion.

Figure 3:
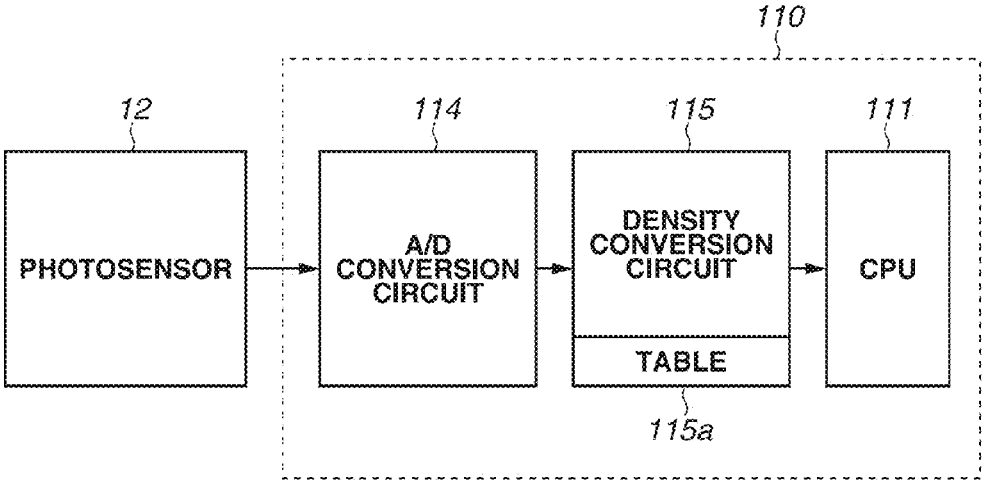
FIG. 3 is a diagram of a connection relation between a photosensor and a control unit.

As illustrated in FIG. 3, the voltage value (0 to 5 V) output from the light receiving unit 12*b* of the photosensor 12 is converted into an 8-bit digital signal (0 to 255) by an analog-to-digital (A/D) conversion circuit 114 included in the control unit 110. This digital signal is converted into density data by a density conversion circuit 115. The density conversion circuit 115 converts the digital signal into the density data using a table 115*a* stored in the RAM 112. The table 115*a* is provided for each color of the measurement image. The control unit 110 measures the density of the measurement image by setting the table 115*a* corresponding to the color of the measurement image, in the density conversion circuit 115.

(Density Control R)

Figure 4:
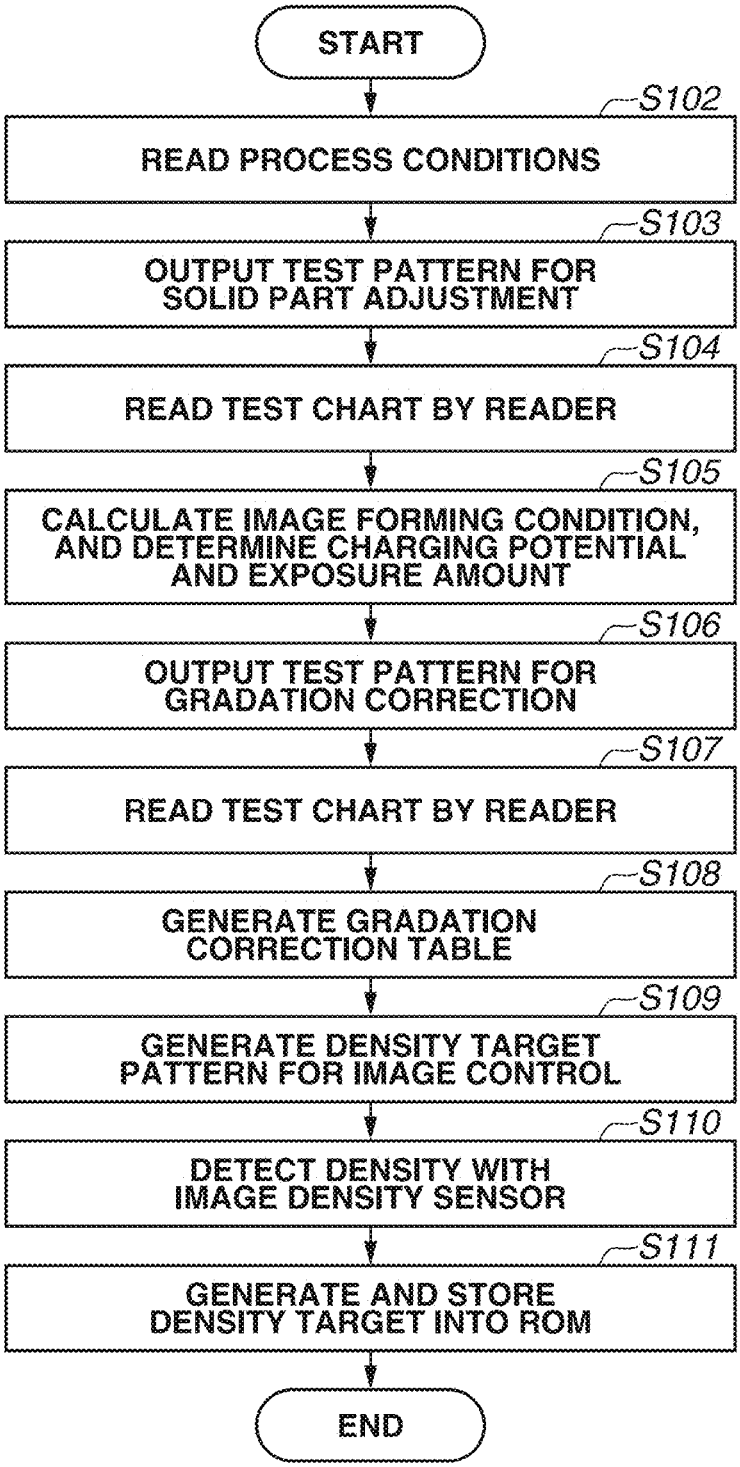
FIG. 4 is a flowchart illustrating density control R.

Next, the density control R will be described based on FIGS. 4 to 7. In the density control R, a test chart is read using the reader unit A, and based on a read result obtained by the reader unit A, process conditions are set and a conversion condition is generated. FIG. 4 is a flowchart of the density control R to be executed by the control unit 110. When the user issues an instruction for execution of the density control R using the operation unit 20, the CPU 111 executes the density control R by reading a program stored in the ROM 113.

Upon start of execution of the density control R, in step S102, the CPU 111 reads process conditions stored in the ROM 113. The process conditions include a charging voltage of the charging unit 2, a grid bias, exposure intensity, a developing bias of the developing unit 4, a transfer voltage to be applied to the primary transfer roller 7, a transfer voltage to be applied to the secondary transfer roller 64, and the like. In step S102, the CPU 111 controls the laser light quantity control circuit 190 and a power source unit (not illustrated) so that the process conditions of each unit become predetermined process conditions stored in the ROM 113.

Figure 5A:
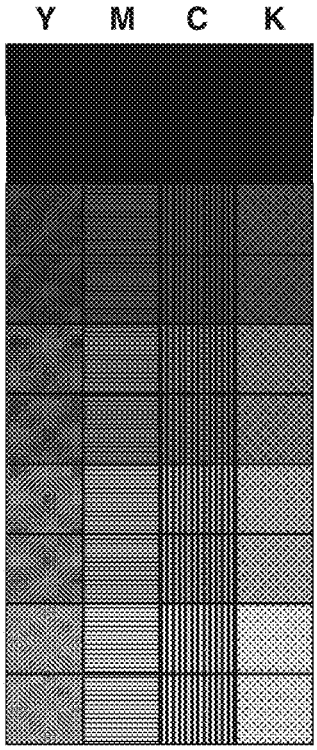
FIGS. 5A and 5B are diagrams each illustrating sample images formed in a test chart.

Upon completion of setting of the process conditions, in step S103, the CPU 111 causes the image forming unit P to form a measurement image corresponding to an image signal of a maximum value (255). In step S103, the CPU 111 controls the image forming unit P to form measurement images corresponding to the image signal 255, while changing the exposure intensity by a predetermined value. In a manner similar to the above-described image forming process, the measurement images are fixed onto a recording material P and then the recording material P is discharged from the image forming apparatus 100. The recording material P, onto which the measurement images formed while changing the exposure intensity are fixed, will be hereinafter referred to as a "test chart 1". FIG. 5A illustrates the measurement images constituting the test chart 1. The measurement images included in the test chart 1 are formed by changing the exposure intensity in ten levels for each color component.

In step S104, the CPU 111 waits until the test chart 1 is read by the reader unit A. When the test chart 1 is placed on the platen 102 and then the read button of the operation unit 20 is pressed by the user, the CPU 214 acquires a read result (luminance data 1) of the test chart 1. The read result (the luminance data 1) of the test chart 1 is converted into density data 1 (read data 1 of the measurement images) using the luminance density conversion table (LUTid_r). The density data 1 is then transmitted to the control unit 110. The CPU 111 acquires the read data 1 of the test chart 1 using the reader unit A.

Figure 6:
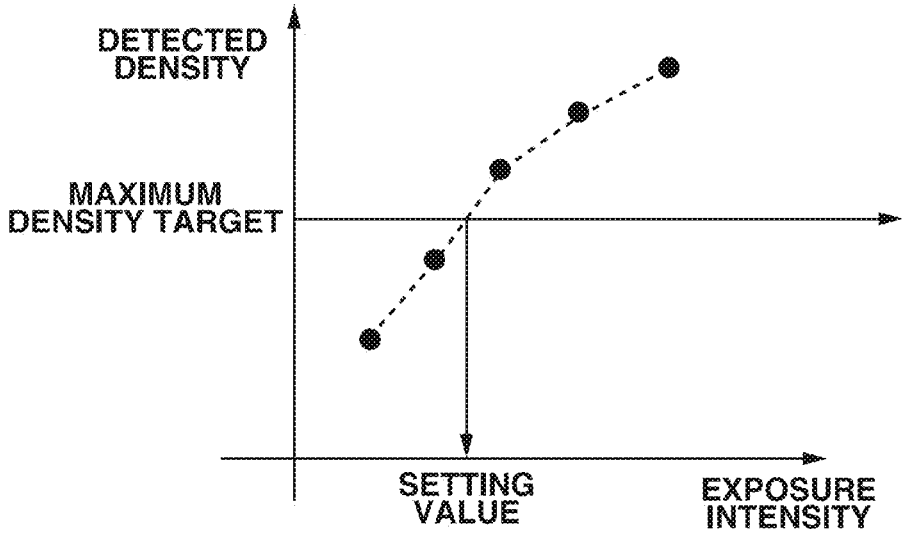
FIG. 6 is a diagram illustrating a read result of a test chart.

In step S105, the CPU 111 determines process conditions based on the read data 1. Here, a case of changing the exposure intensity will be described. FIG. 6 illustrates the read data 1 of the measurement images formed by the image forming unit PY by changing the exposure intensity. A horizontal axis indicates the exposure intensity and a vertical axis indicates density values. The CPU 111 performs linear interpolation on measurement results of measurement images, and determines a setting value of exposure intensity so that a density value becomes a target value. For example, read data obtainable when the reader unit A reads an image having density of 1.6 according to a 530 spectrum densitometer made by X-Rite Inc. is set as the target value. The CPU 111 controls the laser light quantity control circuit 190 so that the exposure intensity of the exposure unit 3 becomes the setting value.

Figure 5B:
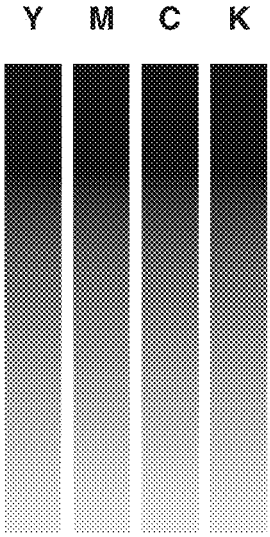

The description continues returning to the flowchart of FIG. 4. After the process conditions are determined, the CPU 111 generates a gradation correction table. Specifically, in step S106, the CPU 111 controls the image forming unit P to form an image pattern (measurement images) on a recording material P, and then the recording material P is discharged. FIG. 5B illustrates the image pattern, which has a 64-level gradation and is formed on the recording material P for generating a gradation correction table. In a manner similar to the above-described image forming process, the image pattern is fixed onto the recording material P and then the recording material P is discharged from the image forming apparatus 100. The recording material P on which the image pattern with the 64-level gradation is formed will be hereinafter referred to as a "test chart 2". FIG. 5B illustrates the measurement images constituting the test chart 2.

In step S107, the CPU 111 waits until the test chart 2 is read by the reader unit A. When the test chart 2 is placed on the platen 102 and then the read button of the operation unit 20 is pressed by the user, the CPU 214 acquires a read result (luminance data 2) of the test chart 2. The read result (the luminance data 2) of the test chart 2 is converted into density data 2 (read data 2 of the measurement images) using the luminance density conversion table (LUTid_r), and the density data 2 is then transmitted to the control unit 110. The CPU 111 acquires the read data 2 of the test chart 2 using the reader unit A.

Based on the read result of the test chart 2 obtained by the reader unit A, the CPU 111 acquires a γ characteristic indicating a signal level of an image signal and a density value of a measurement image formed according to this image signal. In step S108, the CPU 111 generates a gradation correction table using the γ characteristic and a gradation target prestored in the ROM 113. The image forming apparatus 100 stores the gradation correction table generated in step S108, into the RAM 112. The control unit 110 converts the image data using the gradation correction table generated in step S108, and causes the image forming unit P to form an image based on the converted image data, so that the image formed on the recording material P has desired density.

Figure 7:
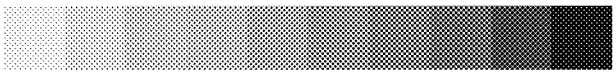
FIG. 7 is a diagram illustrating a test pattern R.

Next, a density target value to be used in the density control A (FIG. 8) is determined. In step S109, the CPU 111 causes a test pattern R to be formed on the photosensitive drum 1. Specifically, the CPU 111 causes a pattern generator 192 to output measurement image data, and corrects the measurement image data using the gradation correction table generated in step S108. Next, the CPU 111 controls the image forming unit P to form the test pattern R on the photosensitive drum 1 based on the corrected image data. FIG. 7 is a schematic diagram of the test pattern R. The test pattern R is formed based on image signals of predetermined 10 gradations. The image signals of respective measurement images constituting the test pattern R are prestored in the ROM 113.

In step S110, the CPU 111 measures density of the test pattern R using the photosensor 12. In step S111, the CPU 111 stores a measurement result of the test pattern R into the RAM 112, as a density target value. After the density target value is determined, the CPU 111 terminates the density control R.

(Density Control A)

In the density control R, the user needs to issue the instruction for execution of the density control R via the operation unit 20, and then to cause the reader unit A to read the test charts 1 and 2. To update the process conditions and the conversion condition without bothering the user, the image forming apparatus 100 executes the density control A.

Figure 8:
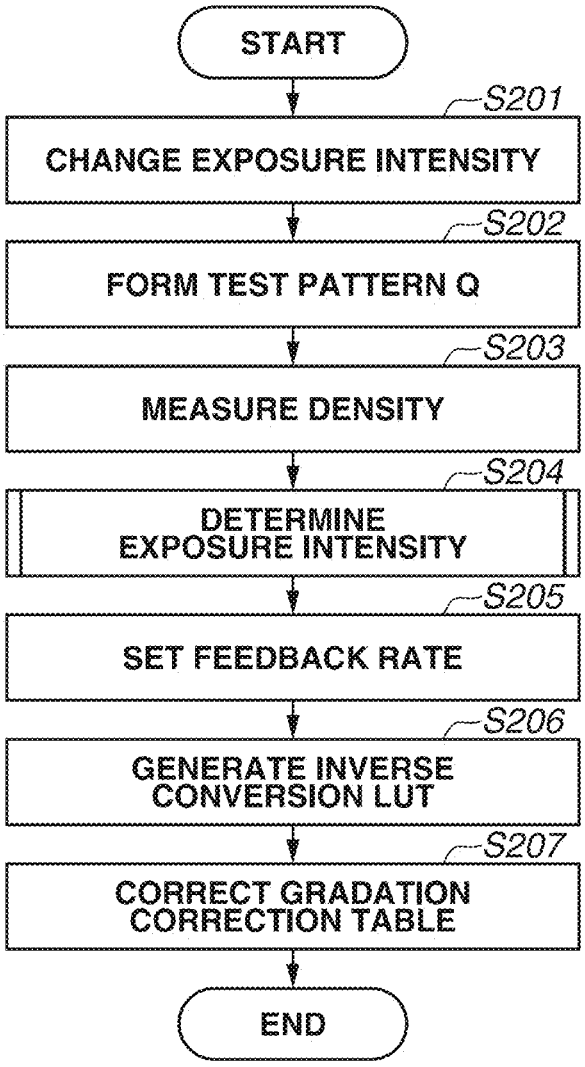
FIG. 8 is a flowchart of density control A.

The density control A will be described based on FIGS. 8, 9A, and 9B. In the density control A, based on a result of measuring a measurement image by the photosensor 12, the conversion condition is corrected, and the process conditions are changed. The density control A is a process of updating the gradation correction table each time the number of pages of images formed by the image forming unit P exceeds a predetermined number of pages. When the number of print pages counted by a counter (not illustrated) reaches 100 pages, the CPU 111 executes the density control A by reading a program stored in the ROM 113.

Upon start of execution of the density control A, in step S201, the CPU 111 reads the process conditions determined in the last density control A, and controls the image forming unit P to achieve the read process conditions. When the density control A is executed first after the density control R is executed, the process conditions correspond to the process conditions determined in the density control R.

Next, in step S202, the CPU 111 causes a test pattern Q to be formed on the photosensitive drum 1. Specifically, the CPU 111 causes the pattern generator 192 to output measurement image data, and causes the γ correction circuit 209 to convert the measurement image data using the gradation correction table stored in the ROM 113. The CPU 111 controls the image forming unit P to form the test pattern Q on the photosensitive drum 1 based on the measurement image data converted by the γ correction circuit 209.

Figure 9A:
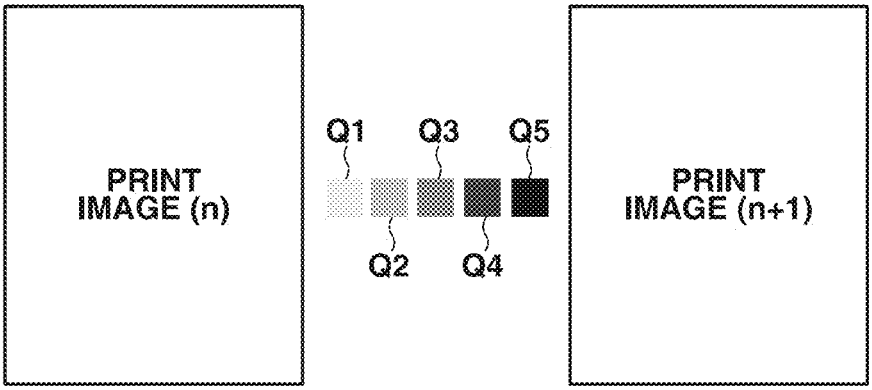
FIGS. 9A and 9B illustrate a test pattern Q, and a measurement result of the test pattern Q, respectively.
Figure 9B:
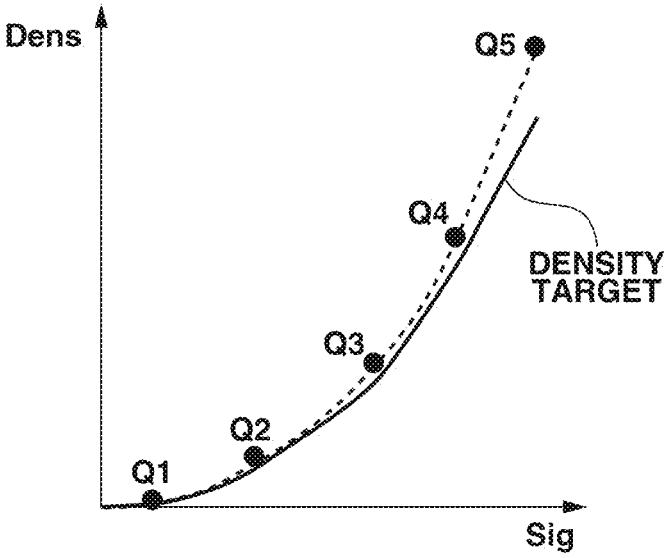

FIG. 9A is a schematic diagram of the test pattern Q. When the image forming unit P successively forms images, the test pattern Q is formed in an area between an image of an nth page and an image of an (n+1)th page where no image is formed. In other words, the test pattern Q is formed between a first image and a second image following the first image. The test pattern Q includes measurement images Q1, Q2, Q3, Q4, and Q5. The measurement image data for forming each measurement image is prestored in the ROM 113. An image signal for forming the measurement image Q5 is assumed to be, for example, a 255-level input signal value.

Next, in step S203, the CPU 111 measures density of the test pattern Q using the photosensor 12. Then, in step S204, the CPU 111 determines exposure intensity by comparing a measurement result of each of the measurement images Q1, Q2, Q3, Q4, and Q5 obtained by the photosensor 12, with the density target value stored in the ROM 113 in the density control R.

Here, a process of determining the exposure intensity in step S204 will be described. The CPU 111 determines the exposure intensity based on the density of the measurement image Q5 and a density target value Q5tgt corresponding to the measurement image Q5. The CPU 111 determines a change amount of the exposure intensity using a table (Table 1) stored in the ROM 113.

TABLE 1

| | Q5 ≤ Q5tgt − 40 | Q5tgt − 40 < Q5 ≤ Q5tgt − 30 | Q5tgt − 30 < Q5 ≤ Q5tgt − 20 |
|---|---|---|---|
| Change amount of exposure intensity | +3 | +2 | +1 |
| | Q5tgt + 20 ≤ Q5 < Q5tgt + 30 | Q5tgt + 30 ≤ Q5 < Q5tgt + 40 | Q5tgt + 40 ≤ Q5 |
| Change amount of exposure intensity | −1 | −2 | −3 |

For example, in a case where the density of the measurement image Q5 is 220 and the density target value Q5tgt is 255, the exposure intensity is increased by two steps. Further, for example, in a case where the density of the measurement image Q5 is 255 and the density target value Q5tgt is 240, the exposure intensity is not changed. An increase in the signal value, which is to be supplied to the semiconductor laser by the laser light quantity control circuit 190 when the CPU 111 increases the exposure intensity by one step, is predetermined. The CPU 111 thus determines the exposure intensity to be used when the process conditions are changed next time.

When the density of the measurement image Q5 is higher than the density target value Q5tgt, the exposure unit 3 decreases the exposure intensity so as to decrease the density of an image to be formed by the image forming unit P. In contrast, when the density of the measurement image Q5 is lower than the density target value Q5tgt, the exposure unit 3 increases the exposure intensity so as to increase the density of an image to be formed by the image forming unit P. However, when a difference between the density of the measurement image Q5 and the density target value Q5tgt is smaller than a predetermined value, the exposure unit 3 does not change the exposure intensity.

Timing of changing the exposure intensity of the exposure unit 3 to the exposure intensity determined in step S204 is assumed to be timing of executing the density control A next time. This is because, if the exposure intensity at the time of forming a measurement image for correcting the gradation correction table is different from the exposure intensity after the change, an image of desired density cannot be formed. Therefore, the exposure intensity determined in step S204 is changed in step S201 when the density control A is next executed. Further, during a period from first timing when the density control A is executed to second timing when the density control A is next executed, the exposure intensity determined in step S204 is not used, and the exposure intensity used when the test pattern Q is formed is set.

After the exposure intensity is determined in step S204, in step S205, the CPU 111 sets a feedback rate FB based on the density of the measurement image Q5 and the density target value Q5tgt.

The feedback rate FB is a feedback condition (a correction coefficient) that indicates to what extent the density of an image formed using a predetermined signal level is to be corrected relative to a density target value. When the correction coefficient is 1, the gradation correction table is corrected so that a difference between density of a measurement image and a density target value becomes 0. When the correction coefficient is 0.5, the gradation correction table is corrected so that 50% of the difference between the density of the measurement image and the density target value is corrected.

The density control A is executed while images are successively formed. Therefore, the feedback rate FB is desirably set as low a value as possible. This is because, there may be otherwise a clear difference between density of an image of an Nth page that is formed based on the gradation correction table before an update and density of an image of an (N+1)th page that is formed based on the gradation correction table after the update.

For example, if the feedback rate FB is set at 100%, a measurement result includes a measurement error (density unevenness of a measurement image) of the photosensor 12, and therefore, the gradation correction table is excessively corrected, which may prevent formation of an image of desired density.

On the other hand, if the feedback rate FB is set too low, it takes a long time until an image of desired density is formed, after a steep change occurs in the charge amount of the developer stored in the developing unit 4. For example, when a steep change occurs in the charge amount of the developer stored in the developing unit 4, density of a measurement image greatly changes relative to the density target value. For this reason, it takes a long time until the gradation correction table is corrected to a gradation correction table that enables formation of an image of desired density.

Therefore, the feedback rate FB is made variable so that a correction amount of density based on the gradation correction table can be changed according to a change amount of the charge amount of the toner in the developing unit 4.

The CPU 111 determines the feedback rate FB based on a table (Table 2) stored in the ROM 113.

TABLE 2

| | Q5 ≤ Q5tgt − 40 | Q5tgt − 40 < Q5 ≤ Q5tgt − 30 | Q5tgt − 30 < Q5 ≤ Q5tgt − 20 |
|---|---|---|---|
| FB | 1.0 | 0.7 | 0.4 |
| | Q5tgt + 20 ≤ Q5 < Q5tgt + 30 | Q5tgt + 30 ≤ Q5 < Q5tgt + 40 | Q5tgt + 40 ≤ Q5 |
| FB | 0.4 | 0.7 | 1.0 |

For example, in a case where the density of the measurement image Q5 is 220 and the density target value Q5tgt is 255, 0.7 is determined as the feedback rate FB.

If the difference between the density of the measurement image Q5 and the density target value Q5tgt is greater than a threshold, the CPU 111 determines that there is an increase in the change amount of the charge amount of the toner in the developing unit 4, and increases the feedback rate FB. In other words, if the charge amount of the toner in the developing unit 4 increases, a correction amount for a predetermined input value (input level) based on the gradation correction table increases. If the correction amount increases, a difference between an input value input into the gradation correction table and an output value output from the gradation correction table increases.

Further, for example, in a case where the density of the measurement image Q5 is 255 and the density target value Q5tgt is 240, 0.3 is determined as the feedback rate FB. If the difference between the density of the measurement image Q5 and the density target value Q5tgt is less than the threshold, the CPU 111 determines that the change amount of the charge amount of the toner in the developing unit 4 is minute, and decreases the feedback rate FB. If the change amount of the charge amount of the toner in the developing unit 4 is minute, a correction amount for a predetermined input value (input level) based on the gradation correction table decreases. This can prevent the gradation correction table from being excessively corrected based on a measurement error of the photosensor 12.

Next, a method of correcting the gradation correction table will be described. FIG. 9B is a diagram illustrating a relationship between the signal level of the image signal and the density of each of the measurement images Q1, Q2, Q3, Q4, and Q5 measured by the photosensor 12. A solid line represents the density target value (the gradation target) stored in the ROM 113. The CPU 111 performs linear interpolation on measurement results of measurement images, and calculates a predicted density value for each signal level i, using a difference between the density value and the density target value, and the feedback rate set in step S205. The predicted density value is calculated by Expression (1).

$$\text{Predicted density value}=(Yi'-Yi)\times(1-\text{FB})+Yi \quad (1),$$

where, Yi' is a density target value corresponding to a signal level i, and Yi is density of a measurement image at the signal level i.

Figure 10:
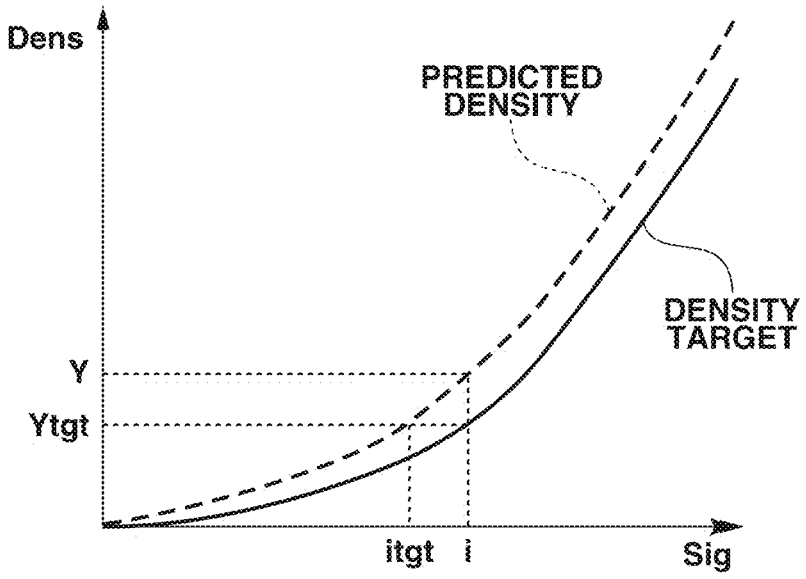
FIG. 10 is a conceptual diagram of an inverse conversion table.

In step S206, the CPU 111 generates an inverse conversion table for converting a signal level of an image signal, using a predicted density value and a density target value, so that density corresponding to an arbitrary image signal becomes a density target value corresponding to the arbitrary image signal. FIG. 10 is an explanatory diagram of the generation of the inverse conversion table. Data of an inverse conversion table for converting a predicted density value Y of a signal level i into a density target value Ytgt is a signal level itgt corresponding to the density target value Ytgt of the signal level i. A table for converting the signal level i into the signal level itgt is the inverse conversion table.

Next, in step S207, the CPU 111 combines the inverse conversion table generated in step S206 with the gradation correction table stored in the ROM 113 to update the gradation correction table and store the updated gradation correction table into the RAM 112. The CPU 111 then sets the count value of the counter (not illustrated) for counting the number of print pages to 0, and terminates the density control A.

Next, the CPU 111 resumes the formation of the image based on the image data. In forming the image based on the image data, the CPU 111 causes the γ correction circuit 209 to correct the image data using the updated gradation correction table stored in the RAM 112. The CPU 111 then causes the image forming unit P to form the image based on the corrected image data. Exposure intensity used in this process is the exposure intensity used when the test pattern Q is formed, not the exposure intensity determined in step S204.

(Comparison of Effects)

Figure 11:
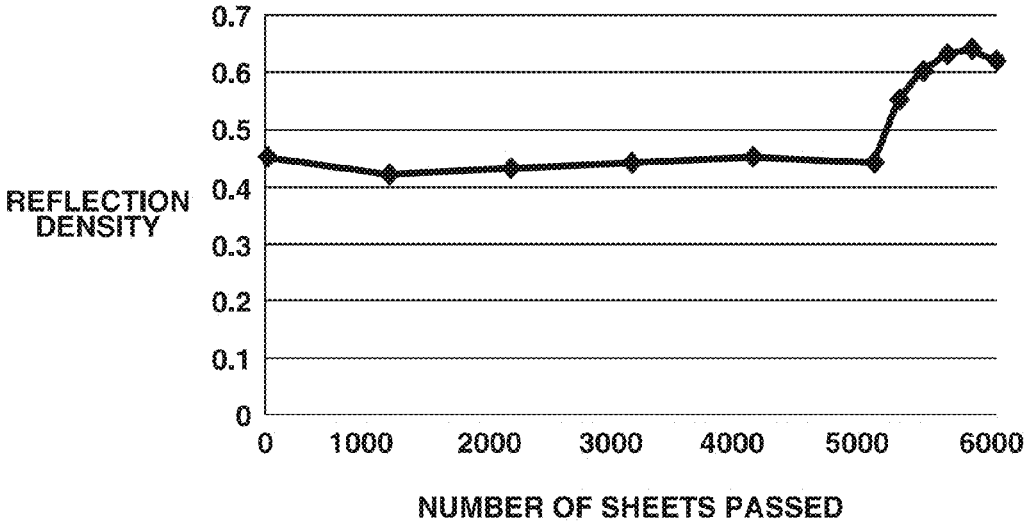
FIG. 11 is a diagram illustrating a density transition of a comparative example.
Figure 12:
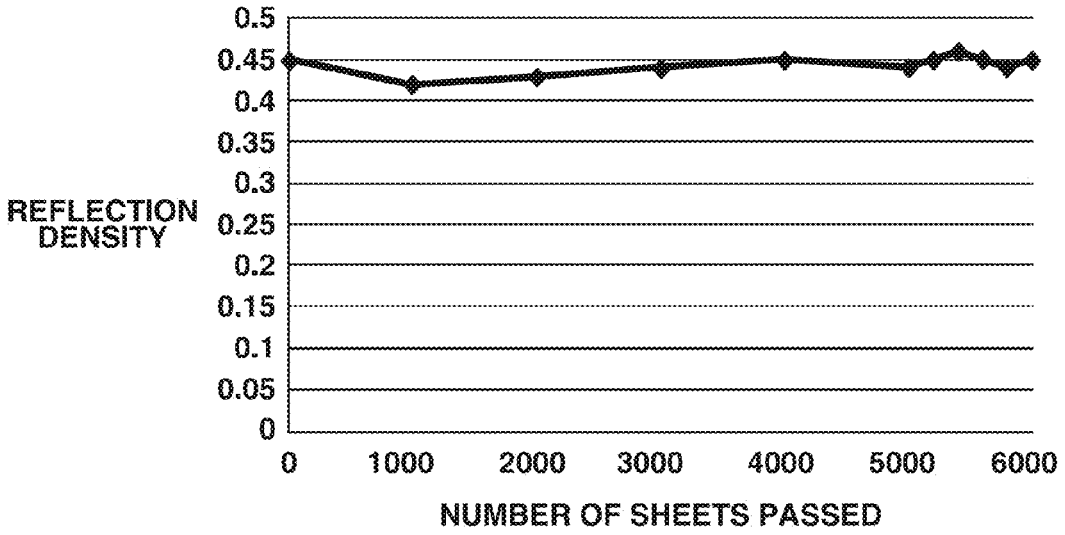
FIG. 12 is a diagram illustrating a density transition.

Assume that an image having a printing ratio of 50% is formed after an image having a printing ratio of 0.5% is formed for 5,000 pages. FIGS. 11 and 12 each illustrate a result of measuring density of an image, which is output every 200 pages after printing of 5,000 pages, and examining a transition in print image density. FIG. 11 is a density transition diagram of a case where the feedback rate FB is fixed at 0.3, and FIG. 12 is a density transition diagram of a case where the feedback rate FB is variable.

In FIG. 11, a steep increase occurs in the print image density after a change occurs in the printing ratio. This indicates that, despite a decrease in the charge amount of the toner in the developing unit 4, the correction amount based on the gradation correction table is smaller than a fluctuation amount in density accompanying the change in the charge amount, and therefore, the print image density exceeds desired density. On the other hand, in FIG. 12, the print image density does not vary so much relative to predetermined density even if a change occurs in the printing ratio. This is because the correction amount based on the gradation correction table is greater than a fluctuation amount in density accompanying the change in the charge amount.

According to the present exemplary embodiment of the present invention, even if the charge amount of the developer changes, fluctuations in density of successively formed images can be suppressed. Further, according to the present exemplary embodiment, the correction amount of the gradation correction table is made variable based on the measurement result of the measurement image. Therefore, it is possible to form an image of desired density even if there is an increase in the fluctuation amount of the print image density, while suppressing an excessive correction due to a measurement error.

In addition, in the above description, the photosensor 12 is configured to measure the density of the measurement images formed on the photosensitive drum 1, but may be configured to measure density of measurement images formed on the intermediate transfer belt 6.

Moreover, in the above description, the test pattern Q with 5 gradations is formed, and the test pattern R with 10 gradations is formed, but the number of measurement images is not limited to these numbers. The number of measurement images can be determined as appropriate.

The image forming apparatus 100 described above corrects the exposure intensity based on the difference between the density of the measurement image Q5 and the density target value Q5tgt. In the following description, the charging voltage is corrected based on the difference between the density of the measurement image Q5 and the density target value Q5tgt.

The CPU 111 determines the charging voltage based on the following table (Table 3).

TABLE 3

| | Q5 ≤ Q5tgt − 40 | Q5tgt − 40 < Q5 ≤ Q5tgt − 30 | Q5tgt − 30 < Q5 ≤ Q5tgt − 20 |
|---|---|---|---|
| Change amount of charging voltage | +10% | +5% | +2% |
| FB | 1.0 | 0.7 | 0.4 |
| | Q5tgt + 20 ≤ Q5 < Q5tgt + 30 | Q5tgt + 30 ≤ Q5 < Q5tgt + 40 | Q5tgt + 40 ≤ Q5 |
| Change amount of charging voltage | −2% | −5% | −10% |
| FB | 0.4 | 0.7 | 1.0 |

When the density of the measurement image Q5 is lower than the density target value, the CPU 111 increases the charging voltage. This increases a toner quantity that adheres to the photosensitive drum 1, thereby increasing the print image density. Further, when the change amount of the charging voltage is increased, the feedback rate FB is also increased. When the change amount of the charging voltage is large, a fluctuation amount in the print image density is also increased, and therefore, it is necessary to increase the correction amount of the gradation correction table. Based on a ratio of the change amount (%) in Table 3, the CPU 111 determines the charging voltage to be used when executing the density control A next time.

According to the present exemplary embodiment of the present invention, even if the charge amount of the developer changes, fluctuations in the density of successively formed images can be suppressed. Further, according to the present exemplary embodiment, the correction amount of the gradation correction table is variable based on the measurement result of the measurement image. Therefore, it is possible to form an image of desired density even if there is an increase in the fluctuation amount of the print image density, while suppressing an excessive correction due to a measurement error.

In addition, in the above description, the photosensor 12 is configured to measure the density of the measurement images formed on the photosensitive drum 1, but may be configured to measure density of measurement images formed on the intermediate transfer belt 6.

Moreover, in the above description, the test pattern Q with 5 gradations is formed, and the test pattern R with 10 gradations is formed, but the number of measurement images is not limited to these numbers. The number of measurement images can be determined as appropriate.

In the image forming apparatus 100 described above, when the CPU 111 determines that the image forming conditions are to be changed, based on the measurement result of the measurement image Q5, the CPU 111 changes the image forming conditions at the timing of the next update of the gradation correction table. In other words, timing when the feedback rate FB is changed differs from timing when the image forming conditions are changed.

In the following description, the CPU 111 performs control so that timing of changing the exposure intensity matches timing of changing the feedback rate FB. In other words, the exposure intensity and the feedback rate FB that are to be used in the timing of the next update of the gradation correction table are determined based on the difference between the density of the measurement image Q5 and the density target value Q5tgt. The CPU 111 then forms the test pattern Q in a state where the exposure intensity is changed, and updates the gradation correction table based on the feedback rate FB determined in the last density control A and a measurement result of the test pattern Q.

This is because, when the exposure intensity is changed immediately, the exposure intensity in subsequent image formation and the exposure intensity used when the test pattern Q is formed become different. The gradation correction table is corrected to be suitable for the exposure intensity used when the test pattern Q is formed. Therefore, if the exposure intensity is changed after the gradation correction table is corrected, a difference between density of an output image and target density may increase. The exposure intensity needs to be changed before the test pattern Q is formed.

Further, the timing of changing the exposure intensity is matched with the timing of changing the feedback rate FB because density characteristics (gradation characteristics) deviate from target density characteristics (target gradation characteristics) if the exposure intensity is changed. Therefore, the feedback rate FB is increased when the exposure intensity for forming the test pattern Q is changed. This enables generation of the gradation correction table suitable for the exposure intensity even if the difference between the density of the test pattern Q and the target density increases.

Figure 13:
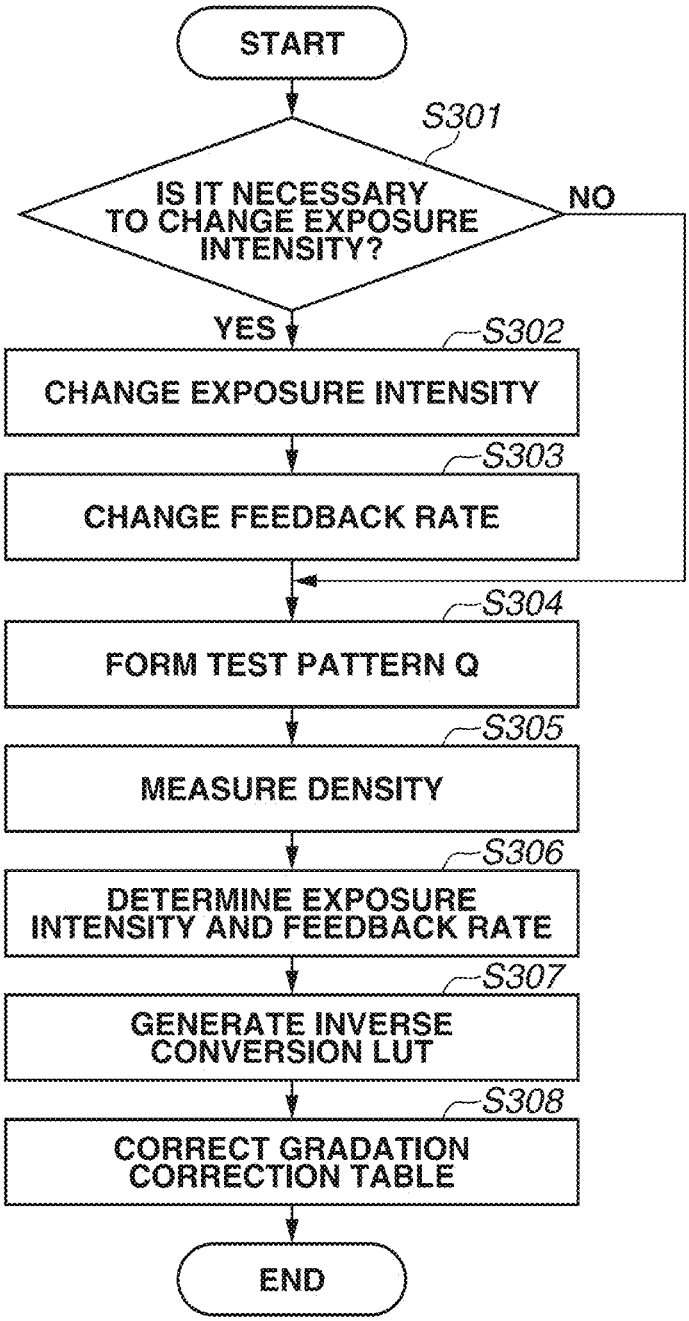
FIG. 13 is another flowchart of the density control A.

Next, the density control A will be described based on FIG. 13, as well as FIGS. 9A and 9B. In the density control A, based on a result of measuring a measurement image by the photosensor 12, the conversion condition is corrected and the process conditions (the image forming conditions) are changed. The density control A is executed each time the number of pages of images formed by the image forming unit P exceeds a predetermined number of pages. The CPU 111 executes the density control A by reading a program stored in the ROM 113. The CPU 111 executes the density control A when the number of pages of images formed by the image forming unit P reaches 100 pages from the timing when the last density control A is executed. Alternatively, the CPU 111 executes the density control A when the number of pages of images formed by the image forming unit P reaches 100 pages from the timing when the last density control R is executed.

When the density control A is executed first after the density control R is executed, the image forming conditions are controlled to be image forming conditions determined in the density control R. Upon start of execution of the density control A, at first, in step S301, the CPU 111 determines whether the exposure intensity needs to be changed. If the exposure intensity needs to be changed (YES in step S301), then in step S302, the CPU 111 changes the exposure intensity based on the change amount of the exposure intensity determined in the last density control A. Further, in step S303, the CPU 111 changes the feedback rate FB if the exposure intensity is changed. A default value of the feedback rate is set at 30%. Therefore, if the exposure intensity does not need to be changed (NO in step S301), the CPU 111 sets the feedback rate FB at 30%.

Next, in step S304, the CPU 111 controls the image forming unit P to form the test pattern Q on the photosensitive drum 1. Specifically, the CPU 111 causes the pattern generator 192 to output measurement image data, and causes the γ correction circuit 209 to convert the measurement image data based on the gradation correction table. In step S304, as the gradation correction table to be used for converting the measurement image data, the gradation correction table generated in the last density control A is used. The image forming unit P forms the test pattern Q (FIG. 9A) on the photosensitive drum 1 based on the converted measurement image data.

The test pattern Q includes the measurement image Q5 formed using the maximum value of an input image signal, and the measurement images Q1, Q2, Q3, and Q4 each formed using an input image signal of a value other than the maximum value. The measurement image data for forming the test pattern Q is prestored in the ROM 113.

Next, in step S305, the CPU 111 measures the density of the test pattern Q using the photosensor 12. In step S306, the CPU 111 determines the exposure intensity and the feedback rate to be set in the next timing, by comparing a measurement result of the test pattern Q obtained using the photosensor 12, with the density target value stored in the ROM 113 in the density control R. In step S306, based on the density of the measurement image Q5 and the density target value Q5tgt, the CPU 111 determines the exposure intensity and the feedback rate to be used in the timing of the next execution of the density control A. The CPU 111 determines a change amount of the exposure intensity using the table (Table 1) stored in the ROM 113. Further, the CPU 111 determines the feedback rate using a table (Table 4) stored in the ROM 113.

TABLE 4

| | Q5 ≤ Q5tgt − 40 | Q5tgt − 40 < Q5 ≤ Q5tgt − 30 | Q5tgt − 30 < Q5 ≤ Q5tgt − 20 | Q5tgt − 20 < Q5 ≤ Q5tgt + 20 |
|---|---|---|---|---|
| FB | 1.0 | 0.7 | 0.4 | 0.3 |

| | Q5tgt + 20 ≤ Q5 < Q5tgt + 30 | Q5tgt + 30 ≤ Q5 < Q5tgt + 40 | Q5tgt + 40 ≤ Q5 |
|---|---|---|---|
| FB | 0.4 | 0.7 | 1.0 |

Furthermore, in step S306, the CPU 111 determines whether the exposure intensity needs to be adjusted, according to a difference between a measurement result (density)

of the measurement image having maximum density of the test pattern Q, and the density target. The CPU 111 determines that the exposure intensity does not need to be changed, if a difference between a measurement result (density) of the measurement image Q5 and a density target value is greater than −20 and less than +20.

On the other hand, if an absolute value of the difference between the measurement result (density) of the measurement image Q5 and the density target value is 20 or more, the exposure intensity needs to be changed. For example, when the difference is 20 or more and less than +30, the density of the test pattern Q is higher than the target density, and therefore, the exposure intensity is decreased by one level to decrease the density of the image. When the CPU 111 determines that the exposure intensity is to be changed, the CPU 111 controls, at the next timing, the laser light quantity control circuit 190 to change the laser power (exposure intensity) of the exposure unit 3 in forming the test pattern Q.

The CPU 111 stores the determination result obtained in step S306, and the change amount of the exposure intensity and the feedback rate FB that are determined in step S306, into the RAM 112. When the density control A is next executed, the CPU 111 determines in step S301 whether the exposure intensity needs to be changed, based on the information stored in the RAM 112. Further, when the CPU 111 determines that the exposure intensity needs to be changed, the CPU 111 changes the exposure intensity based on the change amount stored in the RAM 112.

Next, the CPU 111 updates the gradation correction table (LUT) based on the density target value corresponding to the measurement image of the test pattern Q and the density of the test pattern Q. Specifically, linear interpolation is performed on the input image signal and the measurement result (density) of the test pattern Q, so that density characteristics are obtained. A predicted density value is then determined using a difference between the determined density characteristics and the target density characteristics as well as the current feedback rate FB. Next, in step S307, an inverse conversion table is generated using the predicted density value and the density target value. In step S308, the CPU 111 combines the inverse conversion table with the gradation correction table used for forming the test pattern Q that is stored in the RAM 112, thereby updating the gradation correction table.

After updating the gradation correction table in step S308, the CPU 111 stores the updated gradation correction table into the RAM 112 and terminates the density control A. The updated gradation correction table (LUT) is used in image formation after the density control A is executed.

Even if an absolute value of the difference between the density of the test pattern Q and the density target value is 20 or more, the CPU 111 does not immediately change the exposure intensity and the feedback rate, and changes the exposure intensity and the feedback rate when the density control A is next executed. This is because, if the exposure intensity is immediately changed, the exposure intensity to be used in image formation is not the exposure intensity suitable for the gradation correction table. In other words, the exposure intensity used when the test pattern Q is formed to update the gradation correction table is the exposure intensity suitable for the gradation correction table after the update. Density of an image formed using exposure intensity different from the exposure intensity used when the test pattern Q is formed is not desired density.

According to the present exemplary embodiment of the present invention, even if the charge amount of the developer changes, fluctuations in the density of successively formed images can be suppressed. Further, according to the present exemplary embodiment, the feedback rate is increased if the exposure intensity used when the test pattern Q is formed is changed. Therefore, even if the density characteristics are different from ideal density characteristics due to this change in the exposure intensity, density of an output image can be controlled. Furthermore, when the difference between the density of the test pattern Q and the density target value falls within an allowable range, the exposure intensity is not changed and the feedback rate is set at a predetermined value. Therefore, excessive correction of the gradation correction table can be suppressed.

In addition, in the above description, the photosensor 12 is configured to measure the density of the measurement images formed on the photosensitive drum 1, but may be configured to measure density of measurement images formed on the intermediate transfer belt 6.

Moreover, in the above description, the test pattern Q with 5 gradations is formed, and the test pattern R with 10 gradations is formed, but the number of measurement images is not limited to these numbers. The number of measurement images can be determined as appropriate.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2014-190115 filed Sep. 18, 2014, and No. 2015-143110 filed Jul. 17, 2015, which are hereby incorporated by reference herein in their entirety.

What is claimed is:

1. An image forming apparatus comprising:

a conversion unit configured to convert image data based on a conversion condition;

an image forming unit configured to form an image based on the converted image data;

a transfer unit configured to transfer the image onto a sheet;

a measurement unit configured to measure a plurality of measurement images formed by the image forming unit, the plurality of measurement images including a first measurement image and second measurement images;

a first determination unit configured to determine an image forming condition for adjustment of the maximum density of the image, based on first measurement data corresponding to the first measurement image measured by the measurement unit;

a generation unit configured to generate the conversion condition based on second measurement data corresponding to the second measurement images measured by the measurement unit and a feedback condition for control of an amount by which the conversion condition is corrected based on the second measurement data; and a second determination unit configured to determine the feedback condition based on the first measurement data, wherein the image forming unit forms the plurality of measurement images at first timing, wherein the image forming unit forms the plurality of measurement images at second timing after the first timing, wherein the image forming condition is updated, at the second timing, to the image forming condition determined by the first determination unit, based on the first measurement data corresponding to the first measurement image formed at the first timing, and wherein the conversion condition is updated, before the second timing, to the conversion condition generated by the generation unit, based on the second measurement data corresponding to the second measurement images formed at the first timing.

2. The image forming apparatus according to claim 1, wherein the feedback condition corresponds to a correction coefficient, wherein the second determination unit determines a first correction coefficient in a case where an absolute value of a difference between a first density corresponding to the first measurement data and a target density is smaller than a threshold, and wherein the second determination unit determines a second correction coefficient greater than the first correction coefficient in a case where the absolute value of the difference between the first density and the target density is greater than the threshold.

3. The image forming apparatus according to claim 2, further comprising:

a reader unit configured to read a test image formed on the sheet, and a third determination unit configured to determine the target density based on a read result by the reader unit.

4. The image forming apparatus according to claim 1, wherein the image forming unit includes:

a photosensitive member;

a charging unit configured to charge the photosensitive member;

an exposure unit configured to expose the charged photosensitive member, based on image data converted by the conversion unit, to form an electrostatic latent image; and a developing unit configured to develop the electrostatic latent image to form an image on the photosensitive member, wherein the image forming condition includes intensity of light emitted from the exposure unit, wherein, in a case where a first density corresponding to the first measurement data is higher than a target density, and a difference between the first density and the target density is greater than a first threshold, the exposure unit decreases the intensity of light in the next timing, and wherein, in a case where the first density is lower than the target density, and the difference between the first density and the target density is greater than a second threshold, the exposure unit increases the intensity of light in the next timing.

5. The image forming apparatus according to claim 1, wherein the image forming unit includes:

a photosensitive member;

a charging unit configured to charge the photosensitive member;

an exposure unit configured to expose the charged photosensitive member, based on image data converted by the conversion unit, to form an electrostatic latent image; and a developing unit configured to develop the electrostatic latent image, to form an image on the photosensitive member, wherein the image forming condition includes a charging voltage for the charging unit charging the photosensitive member, wherein, in a case where a first density corresponding to the first measurement data is higher than a target density, and a difference between the first density and the target density is greater than a first threshold, the charging unit decreases the charging voltage in the next timing, and wherein, in a case where the first density is lower than the target density, and the difference between the first density and the target density is greater than a second threshold, the charging unit increases the charging voltage in the next timing.

6. The image forming apparatus according to claim 1, wherein the generation unit generates the conversion condition based on the first measurement data and the second measurement data.

7. The image forming apparatus according to claim 1, wherein a density of the first measurement image is highest among densities of the plurality of measurement images.

8. The image forming apparatus according to claim 1, wherein the conversion condition is corresponds to a gradation correction table for correcting a density characteristic of the image data to a target density characteristic.

9. The image forming apparatus according to claim 1, wherein the image forming unit forms the image on a photosensitive member, wherein the transfer unit transfers the image on the photosensitive member onto the sheet, and wherein the measurement unit measures the plurality of measurement images formed on the photosensitive member by the image forming unit.

10. The image forming apparatus according to claim 1, wherein the image forming unit includes an intermediate transfer member onto which the image on the photosensitive member is transferred, wherein the image forming unit forms the image on the photosensitive member, and transfers the image on the photosensitive member onto the intermediate transfer member, wherein the transfer unit transfers the image on the intermediate transfer member onto the sheet, and wherein the measurement unit measures the plurality of measurement images transferred onto the intermediate transfer member by the image forming unit.

11. The image forming apparatus according to claim 1, wherein the second determination unit determines the feedback condition from among a plurality of feedback conditions, based on the first measurement data.

12. The image forming apparatus according to claim 1, wherein the second determination unit determines the feedback condition, based on a difference between a first density corresponding to the first measurement data and a target density.

13. The image forming apparatus according to claim 12, wherein the second determination unit determines the feedback condition, based on an absolute value of the difference between the first density and the target density.

14. The image forming apparatus according to claim 13, wherein the feedback condition corresponds to a correction coefficient, and wherein in a case where the absolute value increases, the correction coefficient determined by the second determination unit increases.

15. An image forming apparatus comprising:

a conversion unit configured to convert image data based on a conversion condition;

an image forming unit configured to form an image based on the converted image data;

a transfer unit configured to transfer the image onto a sheet;

a measurement unit configured to measure measurement images formed by the image forming unit;

a controller configured to control the image forming unit to form the measurement images, and control the measurement unit to measure the measurement images;

a determination unit configured to determine a feedback condition for control of a correction amount of the conversion condition, based on a measurement result by the measurement unit; and a correction unit configured to correct the conversion condition, based on the measurement result and the feedback condition, wherein the measurement images include a first measurement image and a second measurement image, wherein the determination unit determines the feedback condition, based on a measurement result of the first measurement image, and wherein the correction unit corrects the conversion condition, based on the measurement result of the first measurement image, a measurement result of the second measurement image, and the feedback condition.

* * * * *